US009309620B2

(12) United States Patent
Amils et al.

(10) Patent No.: US 9,309,620 B2
(45) Date of Patent: Apr. 12, 2016

(54) COMPACTED HYBRID ELEVATOR ROPE

(75) Inventors: Xavier Amils, Kortrijk (BE); Lasley Trindade De Avila, Barueri (BR)

(73) Assignee: NV BEKAERT SA, Zwevegem (BE)

( * ) Notice: Subject to any disclaimer, the term of this patent is extended or adjusted under 35 U.S.C. 154(b) by 266 days.

(21) Appl. No.: 13/882,558

(22) PCT Filed: Oct. 3, 2011

(86) PCT No.: PCT/EP2011/067230

§ 371 (c)(1),
(2), (4) Date: Apr. 30, 2013

(87) PCT Pub. No.: WO2012/059284

PCT Pub. Date: May 10, 2012

(65) Prior Publication Data

US 2013/0227926 A1 Sep. 5, 2013

(30) Foreign Application Priority Data

Nov. 5, 2010 (EP) ..... 10190081

(51) Int. Cl.
*D07B 1/06* (2006.01)
*D07B 5/00* (2006.01)
(Continued)

(52) U.S. Cl.
CPC ..... *D07B 1/0686* (2013.01); *D07B 1/068* (2013.01); *D07B 3/00* (2013.01); *D07B 5/00* (2013.01); *D07B 5/007* (2013.01); *D07B 1/144* (2013.01); *D07B 2201/102* (2013.01); *D07B 2201/1032* (2013.01); *D07B 2201/2043* (2013.01); *D07B 2201/2055* (2013.01); *D07B 2205/106* (2013.01); *D07B 2205/3025* (2013.01); *D07B 2205/3057* (2013.01); *D07B 2205/3071* (2013.01); *D07B 2205/3092* (2013.01); *D07B 2501/2007* (2013.01)

(58) Field of Classification Search
CPC ..... D07B 1/068; D07B 1/0686; D07B 5/00; D07B 5/007; D07B 3/00
See application file for complete search history.

(56) References Cited

U.S. PATENT DOCUMENTS

RE29,537 E * 2/1978 Adams et al. ..... 57/211
4,270,341 A * 6/1981 Glushko et al. ..... 57/215
(Continued)

FOREIGN PATENT DOCUMENTS

EP 1 213 250 A1 6/2002
EP 2 055 829 A1 5/2009
(Continued)

OTHER PUBLICATIONS

Ernst Wolf: "Steel—a material offering potential for enhanced performance and energy efficiency", Mar. 2, 2009. XP055018833. Internet Article Retrieved from the Internet: URL:http://www.lift-report.de/index.php/news/288/357/Further-development-of-proven-suspension-means-in-elevator-construction [retrieved on Feb. 8, 2012] the whole document.
(Continued)

*Primary Examiner* — Shaun R Hurley
(74) *Attorney, Agent, or Firm* — Foley & Lardner LLP

(57) ABSTRACT

A rope (20) comprising a core element (22) surrounded by a plurality of helically twisted and compacted steel strands (24) comprising steel wires (25, 26, 27) having a nominal tensile strength of at least 1960 N/mm$^2$. The core element (22) comprises natural fibers having a linear density of at least 50 g/m.

16 Claims, 2 Drawing Sheets

(51) Int. Cl.
*D07B 3/00* (2006.01)
*D07B 1/14* (2006.01)

(56) References Cited

U.S. PATENT DOCUMENTS

| | | | | |
|---|---|---|---|---|
| 4,827,708 | A * | 5/1989 | Verreet | 57/212 |
| 4,936,647 | A * | 6/1990 | Carroll | 385/107 |
| 5,651,245 | A * | 7/1997 | Damien | 57/220 |
| 5,765,357 | A | 6/1998 | Burgess et al. | |
| 6,295,799 | B1 * | 10/2001 | Baranda | 57/221 |
| 6,563,054 | B1 * | 5/2003 | Damien et al. | 174/120 C |
| 7,191,585 | B2 | 3/2007 | Vanderbeken et al. | |
| 2001/0017027 | A1 * | 8/2001 | Misrachi | 57/215 |
| 2010/0043381 | A1 * | 2/2010 | Van Zyl | 57/215 |
| 2010/0071340 | A1 * | 3/2010 | Ridge et al. | 57/220 |
| 2013/0318937 | A1 * | 12/2013 | Takeuchi et al. | 57/220 |

FOREIGN PATENT DOCUMENTS

| | | | |
|---|---|---|---|
| FR | 1 190 169 | A | 10/1959 |
| GB | 2 320 933 | A | 7/1998 |

OTHER PUBLICATIONS

Barthel Thomas: "Ropes and rope constructions", May 2, 2008, XP002669148, Internet article Retrieved from the Internet: URL:http://www.lift-report.de/index.php?mact=News,cntntOl,print,0&cntntOlarticleid=325&cntntOlshowtemplate =false&cntntOlreturn id=364 [retrieved on Feb. 9, 2012] p. 3, last paragraph-p. 5, paragraph 1.

Molkow M. et al.: "Educational Focus: Elevator Suspension Systems Wire Rope for Elevator Suspension", Elevator World, vol. 51, No. 5, May 1, 2003, XP001162679, Elevator World Inc., Birmingham, AL, US ISSN: 0013-6158 figure 24.

Wolf Ernst: "Rope development for elevators", Sep. 2, 2005, XP002669100, Internet Article Retrieved from the Internet: URL:http://www.lift-report.de/index.php/news/145/385/Rope-development-for-elevators [retrieved on Feb. 8, 2012] the whole document.

Anonymous: "Special Wire Ropes", Casar, 2007, pp. 1-48, XP002669101, Kirkel, Germany, p. 15-p. 19.

Barthel Thomas: "Ropes and rope constructions", Feb. 9, 2008, XP002669102, Internet Article Retrieved from the Internet: URL:http://www.lift-report.de/index.php/news/306/366/Ropes-and-rope-constructions [retrieved on Feb. 8, 2012] p. 1, paragraph 1-p. 3, paragraph 1.

Scheunemann Wolfgang: "Calculating the service life of steel wire ropes in elevators", Sep. 2, 2009, XP002669103, Internet Article Retrieved from the Internet: URL:http://www.lift-report.de/index.php/news/257/360/Calculating-the-service-life-of -steel-wire-ropes-in-elevators [retrieved on Feb. 8, 2012] p. 5, paragraph 1; figure 7.

* cited by examiner

COMPACTED HYBRID ELEVATOR ROPE

TECHNICAL FIELD

The invention relates to a wire rope for traction elevators.

BACKGROUND ART

Steel wire ropes are widely used in traction elevators and are primarily classified into two general classes. The first is 8×19 class, which contains eight metal strands wound around a fiber core, and the second is 6×19 class, which contains six metal strands wound around a fiber core. A steel wire rope during its operation in a traction elevator is bent under tension over sheaves and coiled onto drums. Thus steel wire ropes are subjected to multiple stresses such as flexure, torsion, tension and compression; thus resulting in wear on itself and on the sheaves over which it is bent. In addition, a steel wire rope for traction elevators is also required to comply with safety requirements and provide an adequate service life. Steel wires for elevators have nominal tensile strength of 1370, 1570 and 1770 N/mm$^2$. Typically, outer wires are lower tensile strength than inner wires, therefore pulley abrasion is reduced. Higher strength levels such as 1960 N/mm$^2$ though desirable, cannot be used due to high levels of contact pressure, a higher degree of groove wear or the effect of rope impression occurs. One solution to this problem is to use hardened sheaves. Such a solution will involve added costs and labor of replacing both the sheaves and the rope. Another problem with a typical elevator rope with a fibre core is that said rope cannot achieve low stretch as compared to ropes produced with steel core.

EP-A1-1 213 250 discloses a rope which comprises a fibrous core element surrounded by a plurality of helically twisted steel strands. The fibres of the fibrous core element are natural fibres. The tensile strength of the wires of the strands may be more than 3000 N/mm$^2$. The rope is to be used in an elevator drive system.

SUMMARY OF INVENTION

It is an object of at least certain embodiments of the present invention to devise a rope for a traction elevator. It is an object of at least certain embodiments of the present invention to devise a rope with low stretch, high breaking load and high bending fatigue.

It is further object of at least certain embodiments of the present invention to devise a rope for traction elevator that has an adequate service life and minimizes the number of replacements thus saving labour, cost and time.

Thus, one aspect of the invention is a rope comprising a core element surrounded by a plurality of helically twisted and compacted steel strands comprising steel wires having a nominal tensile strength of at least 1850 N/mm$^2$, e.g. at least 1900 N/mm$^2$, e.g. at least 1960 N/mm$^2$, wherein said core element comprises natural fibres and preferably consists of only natural fibres. Thus such a core comprises a plurality of fibres which may be arranged in parallel or spun to a yarn or thread. Possibly several threads or yarns may be arranged in the core.

The advantage of the rope of the present invention is that lower elongation in service can be achieved when the outer strands of the elevator rope are compacted. To achieve compactness it is necessary to initiate with strand ropes of higher diameter construction and the consequence of such construction is increase in the weight of such elevator rope compacted to the standard non compacted and fibre core rope.

In addition, in comparison with prior art ropes, less wire fractures are noticed.

In another aspect, the present invention relates a rope for instance having a diameter of 13 mm comprising a core element surrounded by a plurality of helically twisted and compacted steel strands having a nominal tensile strength of at least 1960 N/mm$^2$, wherein said core element is a natural fibre having a linear density of at least 50 g/m. The advantage of the rope of present invention is that rope when used as an elevator rope reduces the contact pressure in between the wire and groove of the sheave elements. Furthermore, compacting the strands and hence deforming plastically the wires in the different direction than the drawn direction, the Rm (tensile strength) is reduced for instance 3-4% and therefore, both combined having beneficial effect on the wear resistance against equipment elements (i.e. sheaves). In addition, rope of present invention has an increase of 10% total elongation at fracture.

In one embodiment, the present invention relates to a rope having an 8×19 strand construction preferably a 19-wire Seale construction. The term "8×19 strand construction" refers to rope design having 8 strands, wherein each strand contains 19 wires using Seale (1-9-9), Warrington (1-6-6+6) and Filler (1-6-6F-12) strand constructions surrounding the core element.

In one embodiment, the present invention relates to a rope having a diameter ranging from 8.0 mm to 13 mm. The standard deviation can range up to 4-5%, preferably up to 2% of the defined rope diameter. For instance a rope referred to having a diameter of 13 mm with a standard deviation of 5% can range from 13+0.65 mm to 13−0.65 mm and still be referred to as a rope of 13 mm.

In one embodiment, the present invention relates to a rope for instance having a diameter of 13 mm comprising a core element surrounded by a plurality of helically twisted and compacted steel strands having a nominal tensile strength of at least 1960 N/mm$^2$, wherein said core element is a natural fibre having a linear density in the range of 55-65 g/m, preferably 60 g/m.

The number of wires of the at least one compacted strand is preferably between 3 and 26, and most preferred 7 or 19. They may be helicoidally twisted and axially aligned. In the case of 7 wires the rope has a 1+6 construction, and in the case of 19 wires having a Seale construction, the rope has a 1+9+9 SZ, ZS, SS or ZZ construction.

The wires of the rope may be made of high-carbon steel. A high-carbon steel has a steel composition as follows: a carbon content ranging from 0.5% to 1.15%, a manganese content ranging from 0.10% to 1.10%, a silicon content ranging from 0.10% to 1.30%, sulfur and phosphorous contents being limited to 0.15%, preferably to 0.10% or even lower; additional micro-alloying elements such as chromium (up to 0.20%-0.40%), copper (up to 0.20%) and vanadium (up to 0.30%) may be added. All percentages are percentages by weight.

In an embodiment of the rope according to the present invention, the wires of the at least one compacted strand and/or rope may be coated. In a preferred embodiment in accordance with the invention, the wires may be coated individually to avoid corrosion in between the wires due to water leakage during extreme weather conditions. This coating may be any coating keeping sufficient coating properties after compacting and may preferably be zinc, zinc-aluminum or zinc-aluminum-magnesium types of alloy. The zinc aluminum coating has an aluminum content ranging from 2 percent by weight to 12 percent by weight, e.g. ranging from 3% to 11%, with a preferable composition around the eutectoid position: Al about 5 percent. The zinc alloy coating further has a wetting agent such as lanthanum or cerium in an amount less than 0.1 percent of the zinc alloy. The remainder of the coating is zinc and unavoidable impurities. Compositions with about 10% aluminum are also common. The zinc aluminum coating has a better overall corrosion resistance than zinc. In contrast with zinc, the zinc aluminum coating is temperature resistant. Still in contrast with zinc, there is no flaking with the zinc aluminum alloy when exposed to high temperatures.

A preferable way of coating the wires is galvanizing, e.g. hot dip galvanizing.

In an embodiment of the rope according to the present invention, the compacting of steel strands is done by means of compacting rolls or by means of Turks heads.

The requirements and specifications for the steel wire ropes for general purposes and as elevator ropes are well defined in guidelines published by the ISO (International organization for standardization). For instance ISO 4344 and ISO 2408 specify minimum requirements for the steel wire ropes for lifts and general purposes and ISO 3108 define the actual determination for actual breaking load. ISO 4345 specify fibre cores for steel wire ropes. ISO 4346 specify lubricants used in steel wire ropes.

In one embodiment of the present invention, the natural fibre core meets all requirements of ISO 4345.

In one embodiment of the present invention, the natural fibre core is lubricated during the manufacturing process and the lubricant content shall range from 10-15% by weight of the dry fibre material which shall be measured by the method as described in ISO 4345 Appendix C.

Viewed from another aspect, the present invention relates to a hoisting rope for traction elevator.

Viewed from still another aspect, the present invention relates to a method of making a hoisting rope.

This method comprises the steps of:

a) providing steel wires with a nominal tensile strength of at least 1960 N/mm$^2$;
b) helically twisting the steel wires into steel strands;
c) compacting the strands;
d) laying the compacted steel strands around a core of natural fibres.

Most preferably, the steel wires are galvanized before helically twisting the steel wires.

BRIEF DESCRIPTION OF FIGURES IN THE DRAWINGS

MODE(S) FOR CARRYING OUT THE INVENTION

Figure 1:
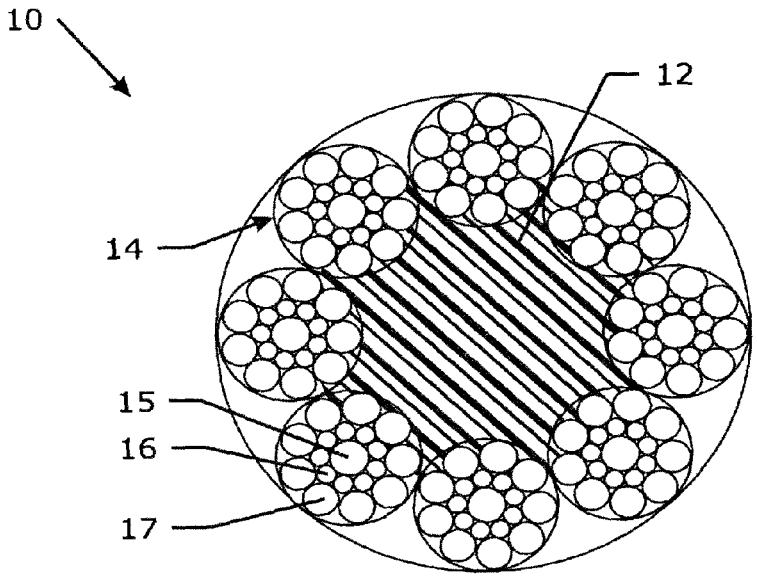
PRIOR ART Fig. 1
FIG. 1 shows a cross-section of a prior art rope.

FIG. 1 shows a cross-section of a prior art rope 10. Prior art rope 10 comprises a core 12 of natural fibres such as hemp and eight strands 14 laid around the core 12. Each strand 14 comprises a core steel wire 15, an intermediate layer of nine steel wires 16 and an outer layer of nine steel wires 17.

Figure 2:
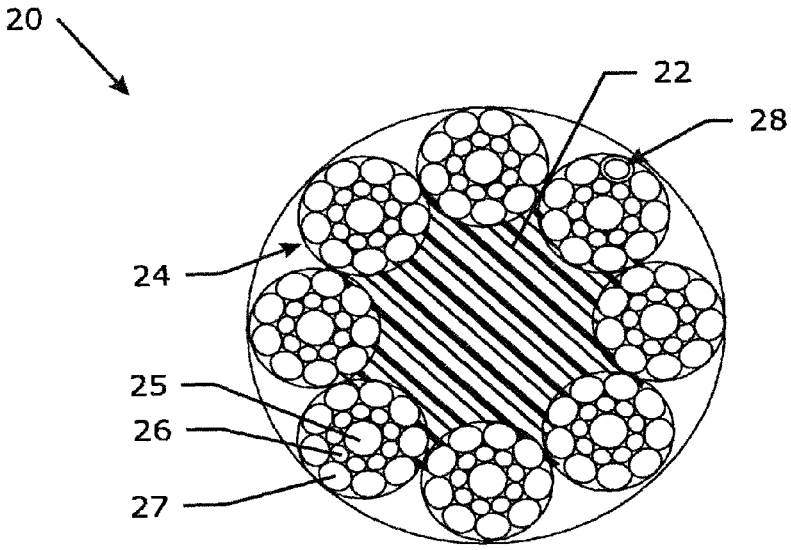
FIG. 2 shows a cross-section of an invention rope.

FIG. 2 shows a cross-section of an invention rope 20. Invention rope 20 comprises a core 22 of natural fibres and eight compacted strands 24 laid around the core 22. Each compacted strand 24 comprises a core steel wire 25, an intermediate layer of nine steel wires 26 and an outer layer of nine steel wires 27.

Each steel wire may have a zinc or zinc aluminum coating 28.

Tests

Fatigue behavior of the rope of an embodiment of the present invention was measured by means of flexlife reverse bend test machine. The procedure for the flexlife reverse bend test was carried out as described in the norm UNE 36480 IN (1997). The test included known "standard sisal core rope" having configuration 8×19+sisal core (1370/1770 N/mm$^2$) and "standard steel core rope" having configuration 8×19+ steel strand core (1770 N/mm$^2$).

Figure 3:
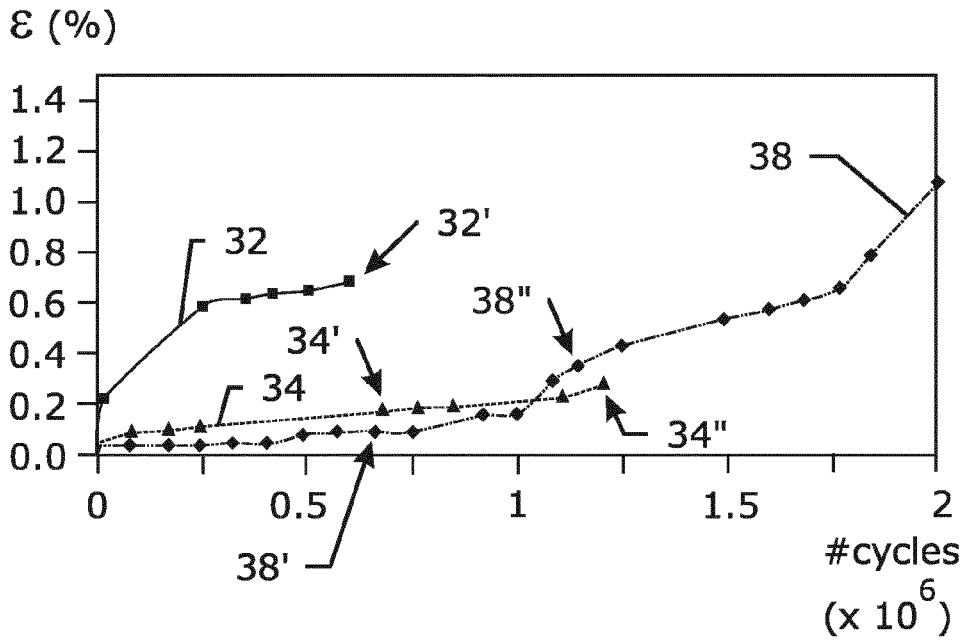
FIG. 3 depicts elongation data from flexlife reverse bend test for various ropes, including an invention rope.

FIG. 3 depicts the elongation of the ropes in percentage (y-axis) versus the number of cycles (x-axis). On various spots along the curves, the number of broken wires will be mentioned.

Curve 32 relates to a prior art rope with Sisal core and non-compacted strands. This rope has 48 wire fractures at 32'.

Curve 34 relates a prior art rope with only steel strands, so also a steel strand core. This rope has 25 wire fractures at 34' and 77 wire fractures at 34".

Curve 38 relates to an invention rope with Sisal core and compacted strands of steel wires. The invention rope has 5 wire fractures at 38' and 10 wire fractures at 38".

Typically, the standard Sisal core rope (curve 32) should have an elongation of approximately 0.5% after 600,000 cycles; while standard steel core rope (curve 34) should record approximately 0.25% after 1,200,000 cycles.

As it can be observed in the FIG. 3, the rope of an embodiment of the present invention has an elongation behavior below to that of steel core up to 1,000,000 cycles.

Thus it can be observed that rope of an embodiment of the present invention has much lower number of broken wires than standard steel core rope. Moreover, the very limited number of broken wires after 1,200,000 cycles allow the rope of an embodiment of the present invention to further run in the test for more than 2,000,000 cycles.

Figure 4:
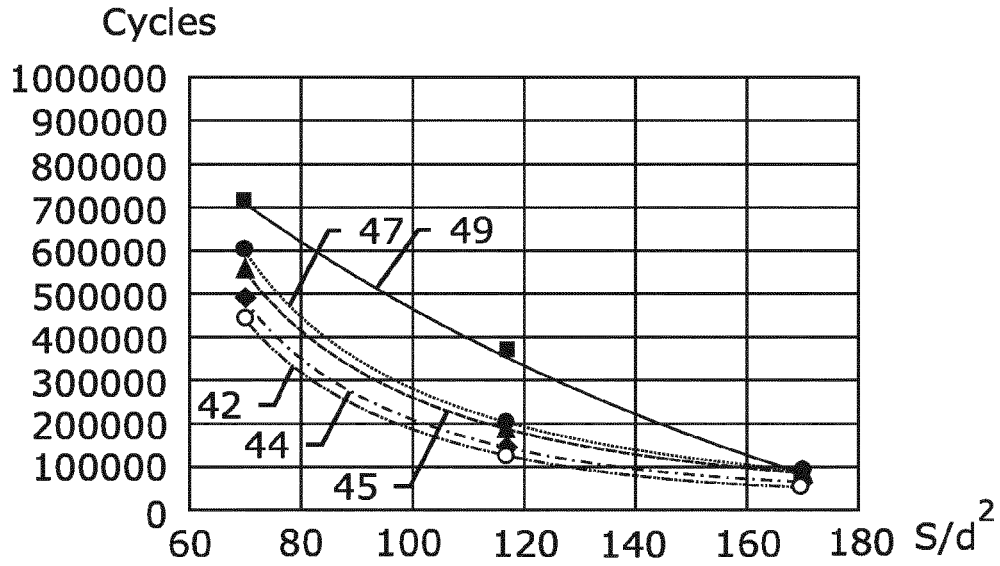
FIG. 4 depicts fatigue results for various ropes, including the invention rope.

FIG. 4 depicts fatigue results for various ropes for a D/d equal to 25, wherein D is the diameter of the pulley and d the diameter of the rope. All the compared ropes have a "core+ 8×19" construction and a rope diameter of 13 mm.

The abscissa is S/d$^2$, which is the load S exercised on the pulley, divided by the square value of the diameter of the rope.

The ordinate is the number of cycles.

Curve 42 relates to a prior art rope with Sisal core and steel wires of 1770 N/mm$^2$ tensile strength.

Curve 44 relates to a prior art rope with Sisal core and steel wires of 1960 N/mm$^2$ tensile strength.

Curve 45 relates to a prior art rope with steel core and steel strands, the steel wires having a tensile strength of 1770 N/mm$^2$.

Curve 47 relates to a prior art rope with steel core and steel strands, the steel wires having a tensile strength of 1960 N/mm$^2$.

Curve 49 relates to an invention rope with Sisal core, compacted steel strands and steel wires having a tensile strength of 1960 N/mm$^2$.

The invention claimed is:

1. A rope comprising a core element surrounded by a single layer comprising a plurality of helically twisted and compacted steel strands, said steel strands comprising steel wires having a nominal tensile strength of at least 1850 N/mm$^2$, wherein a diameter of said rope ranges from 8.0 mm to 13 mm, and said core element comprises natural fibres.

2. The rope of claim 1, wherein said rope is an 8×19 strand construction.

3. The rope of claim 2, wherein said strand construction is a 19-wire Seale strand.

4. The rope of claim 1, wherein said steel wires are galvanized.

5. The rope of claim 1, wherein said core element is lubricated and a lubricant content ranges from 10-15% by weight of a dry portion of said natural fibres.

6. The rope of claim 1, wherein said natural fibres are sisal.

7. The rope of claim 1, wherein said natural fibres have a linear density of at least 50 g/m.

8. The rope of claim 1, wherein said natural fibres have a linear density of 60 g/m.

9. Use of the rope of claim 1 as a hoisting rope for a traction elevator.

10. A hoisting rope for a traction elevator comprising the rope according to claim 1.

11. A method of making the rope according to claim 1, said method comprising the steps of:

a) providing steel wires with a nominal tensile strength of at least 1960 $N/mm^2$;

b) helically twisting said steel wires into steel strands;

c) compacting said helically twisted steel strands;

d) laying a single layer of said helically twisted and compacted steel strands around a core of natural fibres, wherein the rope has a diameter ranging from 8.0 mm to 13 mm.

12. The method according to claim 11, wherein said steel wires are galvanized before helically twisting said steel wires.

13. The rope of claim 1, wherein each helically twisted and compacted steel strand comprises a core steel wire, an intermediate layer of steel wires surrounding said core steel wire, and an outer layer of steel wires surrounding said intermediate layer of steel wires.

14. The rope of claim 1, wherein each helically twisted and compacted steel strand comprises one core steel wire, an intermediate layer consisting of nine steel wires surrounding said core steel wire, and an outer layer consisting of nine steel wires surrounding said intermediate layer.

15. The method of claim 11, wherein each helically twisted and compacted steel strand comprises a core steel wire, an intermediate layer of steel wires surrounding said core steel wire, and an outer layer of steel wires surrounding said intermediate layer of steel wires.

16. The method of claim 11, wherein each helically twisted and compacted steel strand comprises one core steel wire, an intermediate layer consisting of nine steel wires surrounding said core steel wire, and an outer layer consisting of nine steel wires surrounding said intermediate layer.

* * * * *